US006894658B2

(12) United States Patent
Franco

(10) Patent No.: US 6,894,658 B2
(45) Date of Patent: May 17, 2005

(54) ELECTROMAGNETIC PROTECTION ANTENNA FOR PORTABLE TRANSMITTER

(76) Inventor: Abel Franco, 19901 E. Country Club Dr. 2-205, Aventura, FL (US) 33180

( * ) Notice: Subject to any disclaimer, the term of this patent is extended or adjusted under 35 U.S.C. 154(b) by 0 days.

(21) Appl. No.: 10/482,290

(22) PCT Filed: Jul. 2, 2002

(86) PCT No.: PCT/EP02/08675

§ 371 (c)(1),
(2), (4) Date: May 27, 2004

(87) PCT Pub. No.: WO03/005487

PCT Pub. Date: Jan. 16, 2003

(65) Prior Publication Data

US 2004/0201540 A1 Oct. 14, 2004

(30) Foreign Application Priority Data

Jul. 2, 2001 (FR) ..... 01 08726

(51) Int. Cl.[7] ..... H01Q 21/00
(52) U.S. Cl. ..... 343/867; 343/728; 343/742
(58) Field of Search ..... 343/725, 728, 343/842, 741, 742, 866, 867

(56) References Cited

U.S. PATENT DOCUMENTS 3,605,104 A 9/1971 Weston et al. ..... 343/837
3,971,031 A 7/1976 Burke ..... 343/744
4,516,133 A 5/1985 Matsumoto et al. ..... 343/819
4,809,009 A * 2/1989 Grimes et al. ..... 343/726
5,826,178 A * 10/1998 Owen ..... 455/193.1
5,945,958 A * 8/1999 Staufer et al. ..... 343/728

FOREIGN PATENT DOCUMENTS

FR 2 781 088 1/2000

OTHER PUBLICATIONS

Ojiro Y et al:, "A monopole–fed circularly polarized loop atenna", Antennas and Propagation Society International Symposioum, 1998, IEEE Atlanta, GA, USA Jun. 21–26, 1998, New York, NY, USA IEEE, US, Jun. 21–26, 1998, pp. 810–813, XP010292376 atlanta, usa ISBN: 0–7803–4478–2, the whole document.

* cited by examiner

*Primary Examiner*—Shih-Chao Chen
(74) *Attorney, Agent, or Firm*—Young & Thompson

(57) ABSTRACT

An electromagnetic protection antenna for mobile transmitter, includes two substantially planar loops (1, 2) symmetrical relative to an electrically insulated intersecting point. A central antenna (5, 6) is arranged inside each of the loops, each central antenna having a shape substantially homothetic with that of the respective loop.

11 Claims, 1 Drawing Sheet

ELECTROMAGNETIC PROTECTION ANTENNA FOR PORTABLE TRANSMITTER

FIELD OF THE INVENTION

Figure 1:
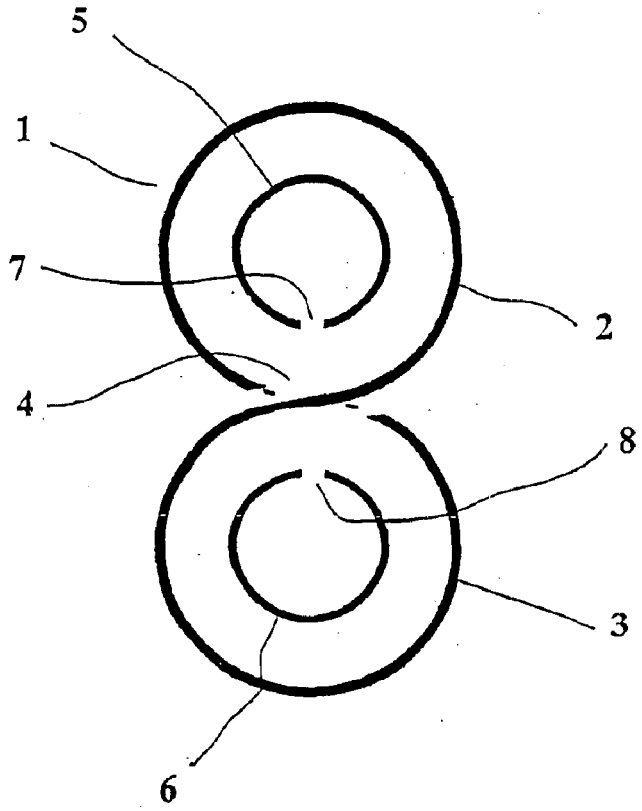

The present invention relates to an antenna providing electromagnetic protection for a mobile transmitter, for example a mobile phone, and more especially to this type of antenna comprising two substantially planar loops, which are symmetrical relative to an electrically insulated intersecting point, so as to ensure a phase difference between the two loops.

BACKGROUND OF THE INVENTION

These types of antennae are already known in FR-A 2 781 088. Although providing satisfaction in general, it has been noted that this type of antenna could be improved so as to make the protection given to the user more effective.

SUMMARY OF THE INVENTION

The present invention intends to supply an antenna of the abovementioned type that is much more efficient.

To this end, the object of the invention is an antenna providing electromagnetic protection for a mobile transmitter, said antenna being of the type comprising two loops which are substantially planar and symmetrical relative to an electrically insulated intersecting point, characterised in that a central antenna is disposed inside each of the loops, each central antenna having a shape which is substantially homothetic relative to that of the respective outside loop.

In a specific embodiment, the dimensions of each central antenna are substantially half of that of the respective outside loop.

In addition, in a specific embodiment, each central antenna forms an open loop.

In addition, in a specific embodiment, each central antenna is connected electrically to the respective loop by a connecting section.

More especially, each of the said connecting sections can be orientated in a radial manner with respect to the point of symmetry.

More especially also, the opening in each of the central antennae can be situated substantially opposite the point of contact of the said central antenna with the said connecting section.

BRIEF DESCRIPTION OF THE DRAWING FIGURES

Figure 2:
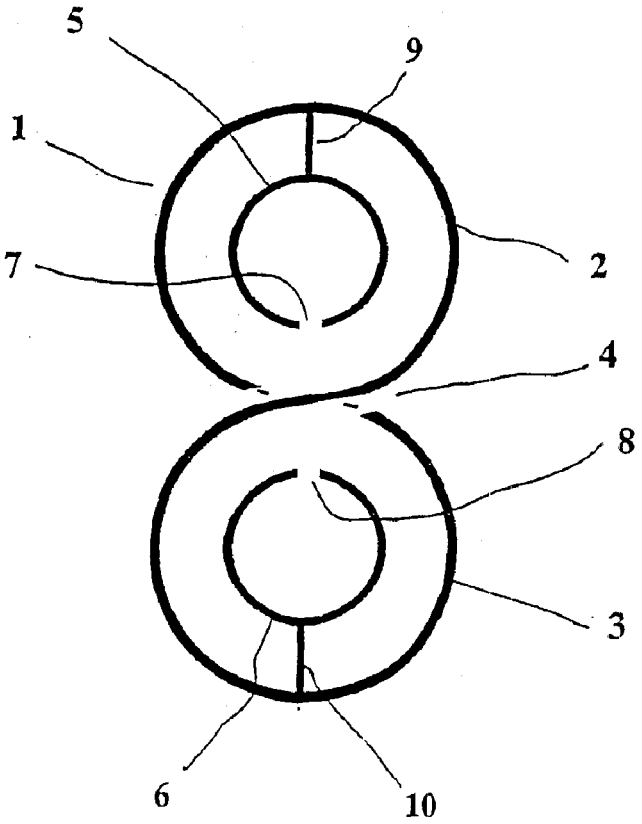

A specific embodiment of the invention is now described by way of a non-restrictive example, referring to the enclosed schematic drawings, in which:

FIG. 1 is a plan view of an antenna according to a first embodiment of the invention, FIG. 2 is a plan view of another embodiment,

DETAILED DESCRIPTION OF ILLUSTRATIVE EMBODIMENTS

FIG. 1 shows an antenna 1 comprising two circular loops 2 and 3, which intersect at a point 4 relative to which they are symmetrical. The intersection of the two loops at the point 4 is effected in such a manner that the two branches are electrically insulated.

A central antenna 5 and 6 is disposed inside each loop 2 and 3 respectively. The central antennae 5 and 6 are also circular and their diameter is substantially equal to half the diameter of the loops 2 and 3.

Each central antenna 5 and 6 is open at a point 7 and 8 respectively, which, in this case, is the point of each antenna nearest to the point of intersection 4. Consequently, the points 4, 7 and 8 are aligned in this case.

The same references are used in FIGS. 1 and 2 for homologous elements.

The embodiment in FIG. 2 differs from that in FIG. 1 by the fact that each central antenna 5 and 6 is electrically connected to the loop inside which it is disposed, by a connecting section 9 and 10 respectively.

The connecting sections 9 and 10, in this case, are rectilinear and are aligned with the point of intersection 4. Consequently, the connecting sections 9 and 10 connect to the central antennae 5 and 6 at their point opposite their opening point 7 and 8 respectively.

The Figures show the antenna loops, and consequently the central circular antennae. Any other shape of closed antenna could obviously be envisaged, for example square, triangular or diamond shapes.

All the antenna wiring can be effected for example by copper deposit, in any known manner, on a flat substrate provided with an adhesive allowing it to be secured on a portable electromagnetic transmitter, for example, a mobile phone, or any other type of transmitter.

What is claimed is:

1. An antenna providing electromagnetic protection for a mobile transmitter, said antenna being of the type comprising two loops (2, 3) which are substantially planar and symmetrical relative to an electrically insulated intersecting point (4), characterised in that a central antenna (5, 6) is disposed inside each of the loops, each central antenna having a shape which is substantially homothetic relative to that of the respective loop.

2. The antenna according to claim 1, in which the dimensions of each central antenna are substantially half of that of the respective loop.

3. The antenna according to claim 1, in which each central antenna forms an open loop.

4. The antenna according to claim 3, in which each central antenna is electrically connected to the respective loop by a connecting section (9, 10).

5. The antenna according to claim 4, in which each of the said connecting sections is orientated in a radial manner with respect to the point of symmetry.

6. The antenna according to claim 4, in which the opening (7, 8) in each of the central antennae is situated substantially opposite the point of contact of the said central antenna with the said connecting section.

7. The antenna according to claim 2, in which each central antenna forms an open loop.

8. The antenna according to claim 1, in which each central antenna is electrically connected to the respective loop by a connecting section (9, 10).

9. The antenna according to claim 2, in which each central antenna is electrically connected to the respective loop by a connecting section (9, 10).

10. The antenna according to claim 8, in which each of the said connecting sections is orientated in a radial manner with respect to the point of symmetry.

11. The antenna according to claim 9, in which each of the said connecting sections is orientated in a radial manner with respect to the point of symmetry.

* * * * *